US005657875A

United States Patent [19]

Hirsh, III et al.

[11] Patent Number: 5,657,875

[45] Date of Patent: Aug. 19, 1997

[54] POP-UP BOX FOR POP-UP GREETING CARDS AND BLANK THEREFOR

[75] Inventors: Allan T. Hirsh, III; Andrew Murphy, both of Baltimore, Md.

[73] Assignee: Creative Horizons, LLC, Baltimore, Md.

[21] Appl. No.: 601,344

[22] Filed: Feb. 16, 1996

[51] Int. Cl.[6] ..... B65D 85/00

[52] U.S. Cl. ..... 206/767; 40/124.06; 40/124.08; 206/215; 206/232

[58] Field of Search ..... 40/124.1, 312, 40/313; 206/45.28, 45.29, 45.3, 215, 232, 457, 767, 768, 444

[56] References Cited

U.S. PATENT DOCUMENTS

| | | | |
|---|---|---|---|
| 2,511,211 | 6/1950 | Klein et al. | 206/45.28 |
| 2,833,074 | 5/1985 | Jannes . | |
| 4,548,352 | 10/1985 | Capo et al. . | |
| 5,096,055 | 3/1992 | Opper . | |
| 5,104,124 | 4/1992 | Bernard et al. . | |
| 5,222,657 | 6/1993 | Holland et al. . | |
| 5,317,823 | 6/1994 | Brunt, II | 206/308.1 |
| 5,458,235 | 10/1995 | Stone . | |
| 5,497,876 | 3/1996 | Fleming | 206/232 |

*Primary Examiner*—Jimmy G. Foster
*Attorney, Agent, or Firm*—Browdy and Neimark

[57] ABSTRACT

A paperboard box is intended for containing pop-up greeting cards and their envelopes. The box includes an additional front cover flap which folds away from the box's front panel section along a hinge line running up one side of the front panel of the box; pop-up figures rise from the box front and the inside surface of the cover flap when the cover flap is moved away from the front section. The cover flap and front panel are removably held together by a fastener, preferably a hook-and-loop fastener (such as VELCRO). The box and the front cover flap may mimic the front and insides of the pop-up greeting cards held by the box, so that buyers need not open the box or handle the cards to examine them. Preferably the front cover flap and the front of the box are both formed of doubled layers of paperboard, so that the pop-up figure cuts are not visible from either inside or outside the box when the cover is closed. The invention also includes a one-piece paperboard blank adapted to be folded and glued to make the box.

14 Claims, 5 Drawing Sheets

POP-UP BOX FOR POP-UP GREETING CARDS AND BLANK THEREFOR

FIELD OF THE INVENTION

The present invention relates to paperboard boxes for greeting cards, especially for pop-up greeting cards.

BACKGROUND OF THE INVENTION

Greeting cards are often sold in boxed sets. So that buyers can see what the card is like, the front of the box is usually printed with the same design as appears on the front pages of the greeting cards in the box. Some card boxes are sealed, for example in clear plastic, so that the cards inside will not be damaged by removal for inspection, accidental opening of the box, and the like.

Boxes with printed covers mimicking the cards are most used with cards that are blank inside; the buyer is of course not curious about the blank inside pages, and will buy the boxed set on the basis of the outside art. Other types are not readily sold in boxes. For example, the type of humorous greeting card with a "punch line" printed on the inside cannot be satisfactorily displayed on a box cover, and these are seldom sold in boxes. Another type of card which cannot readily be sold in boxes is a pop-up card.

Pop-up cards are usually of paperboard and may include two panels, front and back, hinged together along one fold line. They employ die-cuts, perforated lines, and often glue joins to create a "three-dimensional" effect in which portions of the inside of the card "pop up" into raised positions when the card is opened. Pop-up cards of this type often are formed of doubled sheets or panels of paperboard because the perforated and die-cut inner panels must be covered and the outer, uncut panels are needed as supports; the inner panels are glued to the outer in such a way that the inner portions pop up when the card is opened.

(The term "pop-up" as used herein does not cover separate pieces which are pasted onto places of two adjoining card sections, but rather covers popping-up portions of a card or the like which are integral with the surrounding portions of the section which do not pop up; the pop-up portions and the surrounding portions are contiguous along fold lines, and are not separate pieces.)

Boxing of pop-up greeting cards presents the same problem as does boxing of joke cards with inside indicia. Buyers want to see the pop-up before buying, but to do so they must open the box, remove a card, play with it, and then (hopefully) replace it. In this inspection process the cards inside are quite liable to be damaged.

One possible solution, not found in the known prior art, would be to paste one of the cards to be boxed onto the outside of an ordinary card box. However, this would have disadvantages:

For one, the adhesion would be poor; the corners would likely peel away and the bond fail. For another, an additional manufacturing operation is required, and the operation would most likely need to be done by hand. In addition, paperboard would be wasted since the front of the box would include three panels (paperboard layers), when only two are needed. Still another disadvantage is that two sets of cards would need to be printed because the box cover card should include indicia not found on the inside cards, such as price, brand name, and an identification (e.g., "Ten Pop-Up Cards"); since at least one of the other five sides of the card box will preferably also include indicia, three separate printing jobs would be needed.

A complete box, with a complete pop-up greeting card adhered onto it, is thus not an ideal.

If in spite the disadvantages greeting cards were printed and their back sides were firmly fastened to a pop-up greeting card box, the boxes would moreover be awkward to handle and stack. The fold-out front cover flap, which would tend to stick out at an angle from the box's front surface, would hinder stacking or re-shelving, and likely would be damaged by handling. Even if initially formed to lie flat, the cover flap's rest position would tend to work outward away from the box as the flap were repeatedly opened prior to sale.

The prior art does not solve the problem of selling pop-up greeting cards in boxed sets in such a way that potential buyers can examine the pop-up feature while at the same time avoiding damage to the boxed pop-up cards.

U.S. Pat. No. 5,104,124 to Bernard et al shows a card-like novelty item glued to the back of a cereal box. The item is a single layer of heavy paperboard folded down the middle to form two sections, and with a separate piece in the shape of a basketball hoop adhered to that section glued to the cereal box. An extended leg of the piece is adhered to the other panel. When the outer section is folded away from the box, the "hoop" is pulled by the leg to extend outward; the outer section forms a basketball court. A tab-and-slot fastener is used to hold the outer section against the inner. This item is not a true pop-up, is single layer throughout, and is a purely add-on device that is not integrated with the cereal box in any way.

U.S. Pat. No. 4,548,352 to Capo et al discloses a fast-food carton made from a blank, divided by fold lines into sections. The sections include pop-up figures on one side of the carton, which are covered by a fold-down cover when the carton is closed. The fold-down cover section is hinged to the carton along the fold line that runs along the bottom of the carton when it is assembled. The section which folds out is itself divided into two sections by a fold line which is parallel to the fold line along the carton bottom; both fold-out section lie flat on a surface when extended. The inner section is a single layer of paperboard, which lies on a surface such as a table top when the carton is used.

The Capo et al carton would be unsuitable for greeting card use, even if its container shape were changed, because the fold-out sections are not joined into a two-panel cover. Instead, they both lie flat on the table top.

SUMMARY OF THE INVENTION

Accordingly, the present invention has an object, among others, to overcome deficiencies in the prior art such as noted above.

An object of the invention is to provide a box-for pop-up greeting cards which allows a prospective purchaser to see and try the pop-up feature of the cards within the box, without having to open the box and examine the cards themselves.

Still another object is such a box which is made in one piece so as to avoid extra assembly steps and to use the minimum amount of paperboard or other material.

A related object is to provide a blank adapted to form such a box by conventional operations of folding and/or gluing.

A different object of the present invention is to provide a box for pop-up greeting cards which includes a front cover flap that is removably fastened closed, so that the cover flap does not protrude from the box except when it is opened intentionally to examine a pop-up feature of the box and cover flap.

The invention thus provides a box for greeting cards which includes a pop-up feature that is found in greeting cards housed in the box.

In one aspect of the invention, a box for pop-up greeting cards is provided with a fold-out cover flap hingedly joined to the box, the pop-up feature of the cards is displayed between the box front and the cover flap, and the cover flap is removably fastened onto the box so that the cover flap will not hang out from the box to impede stacking or to become damaged.

In another aspect of the invention, a unitary blank for making the box includes a plurality of panel sections connected by fold lines. The blank sections are adapted to be folded and fastened, for example by glue, so that they assemble into a card box whose front cover is hingedly coupled to a cover flap. Both the box front and the cover flap are double-layer glued structures, with their respective facing inside panels being die-cut and perforated so that the desired pop-up feature results. The gluing of the box front and cover flap is on certain selected areas only, so that the portions of the inner panels which separate from the adjoining outer panels are able to rise into the pop-up positions; the remaining portions are preferably glued for rigidity of the box front and cover flap.

An alternative variation on the second aspect of the invention contemplates the blank being in two pieces.

BRIEF DESCRIPTION OF THE DRAWING

The above and other objects and the other aspects, nature, and advantages of the present invention will become more apparent from the following detailed description of an embodiment taken in conjunction with drawings, wherein.

DETAILED DESCRIPTION OF THE PREFERRED EMBODIMENT

Here, and in the following claims:

"blank" means a portion of sheet material (e.g., paperboard, plastic, paper, stiffened fabric, etc.) which is adapted to forming a pop-up structure; it also means a portion of such material that has been die-cut, trimmed, creased, folded, or otherwise treated to adapt it to form a pop-up structure;

"crease" means a region, such as a line in a blank, that has been adapted to act as a hinge between adjacent sections of the blank; as for example by partial perforations or cuts, by creasing, by folding, by deforming the blank material (e.g., crimping), by weakening the blank material in the region by repeated bending or by other means (including chemical and thermal treatments), or by other means or methods;

"fold line" means a line about which folding can or should occur; this term includes a geometrical line about which folding can or should occur, with or without any physical delineation such as a printed line mark, a crease, perforations, or the like;

"panel" indicates in most cases a section of material, such as a section of a blank bordered by fold lines and cut edges, which is in permanent, adjoining, face-to-face contact with another section when the box is assembled, as for example by being glued to the other section; and "pop-up", "pop up" and like terms refer to a construction in which a pair of adjoining sections of a blank (for example, a paperboard blank including two adjoining rectangular sections), where the two sections are foldable relative to one another about a fold line, include cuts and fold lines (e.g. perforations) and the fold lines and cuts join to form a border of at least one un-folded portion of the blank, and, the un-folded portion covers parts of both of the adjoining sections; that is, the fold line between the pair of adjoining sections is interrupted by the non-folding "pop-up" portion.

Also, the "height", "thickness", and "width" of a box is not related to any orientation to gravity, nor is it related to which side of the box includes the box-opening lid which closes the box interior. The side of the box comprising the box lid is not necessarily the "top" side (or any other side referred to gravity) and no assignment of "height", "thickness", or "width" is determined by the lid.

Figure 1:
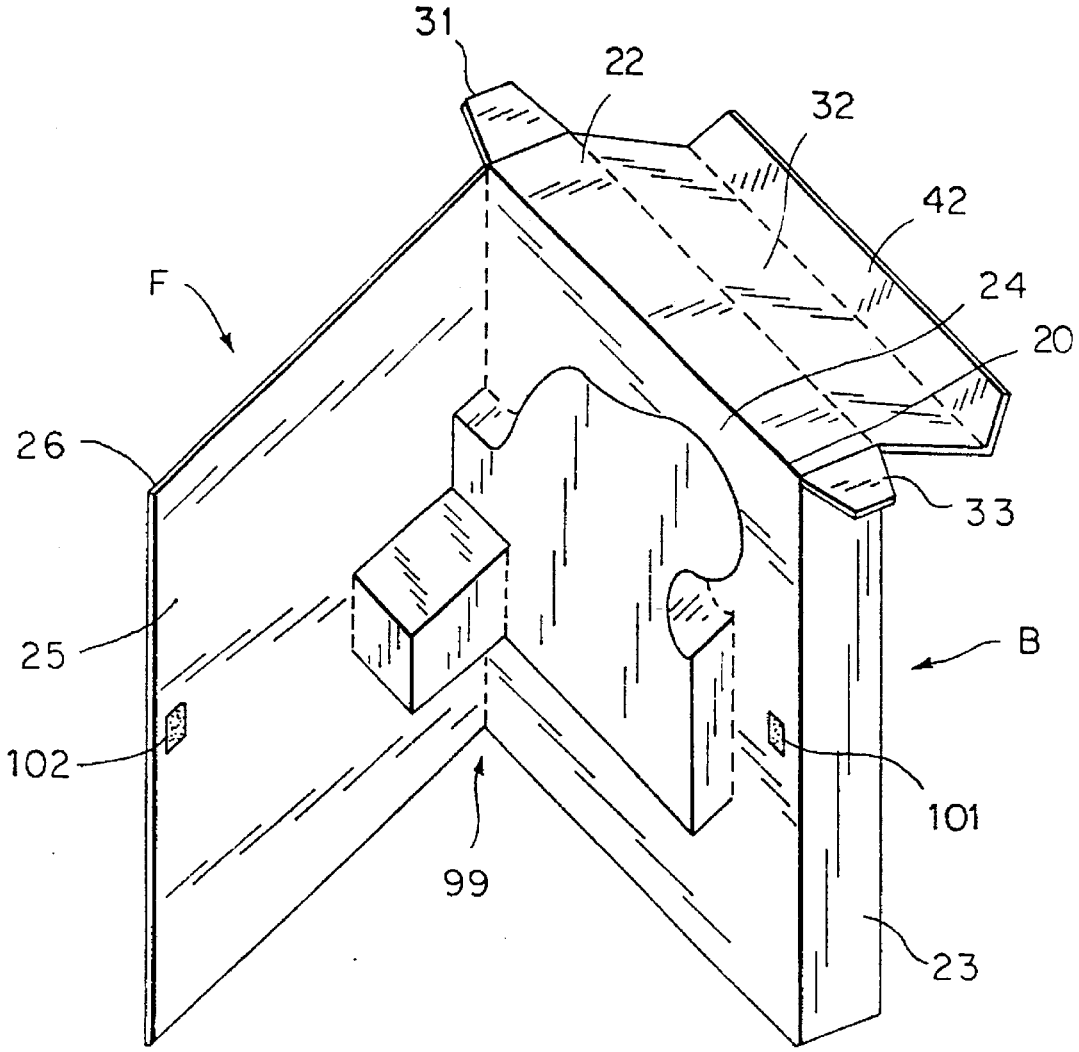
FIG. 1 is a perspective view of the assembled box of the invention.

FIG. 1 shows the assembled box B of the present invention in overview. The box B is preferably of paperboard, but may also be formed of plastic and other materials; one preferred embodiment is paperboard with a plastic coating on one side. A cover flap F is formed of paperboard panels 25, 26 adhered together over certain selected portions of their mutually touching inside surfaces, as explained further below. The cover flap F is hingedly coupled to the box B by a fold line or crease, indicated by a dotted line in FIG. 1.

The front of the box B is formed, like the cover flap F, of two panels adhered together. The box's outer front panel 24 covers the box's inner front panel section 20. Preferably, the outer front panel 24 and the inner front panel section 20 are parts of one wrap-around blank, to increase the strength of the box B.

Disposed between the cover flap F and the box front is a pop-up structure 99. The pop-up structure 99 is formed by cuts and creases (or other sorts of fold lines) which join to form portions, bordered by the cuts and creases, which pop up when the cover flap F is opened away from the box B. At least one of these portions will lie across the hinging fold line between the box B and the cover flap F. Disposed between the pop-up portions, which rise outward upon opening of the cover flap F, and the surrounding parts which do not pop up, are what are herein designated leg portions; the leg portions will usually be generally perpendicular to the cover flap F or to the box front when the cover is opened, but many pop-up designs are possible and the present invention is not limited to any particular angles of the supporting or auxiliary portions.

The paperboard panels 25, 26 of the cover flap F and the panels 20, 24 of the box front are preferably adhered together in those areas which are neither the pop-up portions nor supporting leg portions. These panels must be kept from separating when the cover flap F is opened, or the pop-up feature 99 will not operate. Glue (or a similar area fastening method) is the best way to prevent separation.

When the cover flap F is closed the flap's inner panel section 25 lies over the outer front panel section 24 of the box B; the cover flap F is held to the box B by small patches 101, 102 of hook-and-loop material (e.g., VELCRO). These patches keep the cover flap F closed against the box front panel section 24 when the box B is handled or stacked. Hook-and-loop material is an ideal closure for the cover flap F because it is readily fastened to the box B, for example by hot-melt adhesive, and because with it the cover flap F can be opened or closed simply by pulling on the cover flap F with moderate force. Patches about ¼ inch square are found to give a suitable closure force.

It will be seen that the box of the present invention is an ideal way to package pop-up cards having a pop-up feature that is similar to the pop-up feature 99 of the box B of FIG. 1. This is because the customer who wants buy a pop-up greeting or novelty card will of course want to see the pop-up feature, but if the cards themselves are removed for inspection and trial at least one of the cards will soon be damaged. Then, the entire box of cards will be unmerchantable.

The hook-and-loop fastener 101, 102 prevents the cover flap F from making the box B difficult to stack or replace on a sales rack after a trial of the pop-up feature. Indeed, without the stick-on, pull-off closure 101, 102, the box would be much less suited to selling pop-up greeting cards because it would soon suffer damage.

Figure 2:
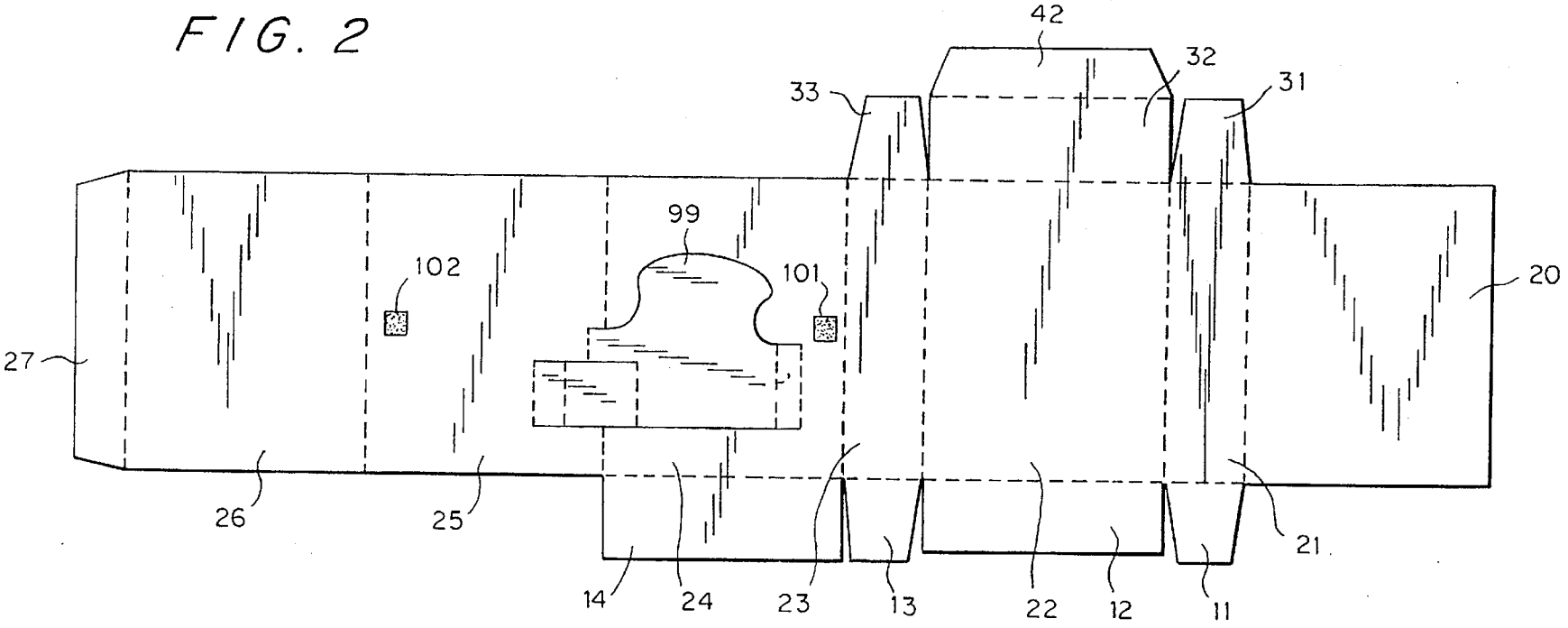
FIG. 2 is a plan view of blanks from which the box of FIG. 1 may be assembled.

FIG. 2 shows a blank which is the preferable form of blank for making the box B of FIG. 1. The blank is divided into sections, each of which abuts its contiguous neighboring section along an intermediate fold line.

The sections of the blank of FIG. 2 may be divided into two sets. The first set forms a core of the blank. When the blank is assembled into the box B of FIG. 1 this first set forms the box's sides, back, front panels and cover flap F. The rectangular sections of the first set are arrayed in linear order. The linear array has a width equal to the box height. In right-to-left order as seen in FIG. 2, the core group of the first set of sections includes: a box inner front panel section 20, measuring the box height by the box width; a box right side section 21, measuring the box height by the box thickness; a box back section 22, measuring the box height by the box width; a box left side section 23, measuring the box height by the box thickness; a box outer front panel section 24, measuring the box height by the box thickness; a flap inner panel section 25, measuring the box height by the box thickness; and a flap outer panel section 26, measuring the box height by the box thickness.

The flap inner panel section 25 and the box outer front panel section 24 include pop-up fold lines and cut lines which form the pop-up feature 99.

The second set of sections surrounds the core array of the first set of blank sections, and includes such things as the box bottom and reinforcement panels.

Still referring to FIG. 2, the second set is seen to include a box lid section 32 that is coupled to the upper edge of either the box back section 22 or the box inside front panel section 20, although the coupling shown is preferred because then the cover flap F opens on the same side as the box lid 32. A closure flap or tab 42 is coupled to the lid 32 along a crease line. This box lid closure tab 42 slips inside the assembled box B to hold the lid 32 closed, in the conventional manner. Top left- and right-side closure tabs 31 and 32 are also provided.

The second set also includes a box outer bottom section 12 and a box inner bottom section 14, which are folded over and glued when the box is assembled. Of course, these two sections may be reversed as to inner and outer, and in either case form a double-panel bottom for the box. The section 12 may also be coupled to the lower edge of either the inner front panel section 20 or the box outer front panel section 24. The bottom of the box may also be formed by a single section having a tab similar to the tab 42.

A flap-facing reinforcement tab 27 is preferably coupled to the flap inner outer panel section 26 at the left-hand end of first set of rectangular sections (as seen in FIG. 2). This tab 27 is glued in between the box inner front panel section 20 and the box outer front panel section 24 when the box is assembled. The tab 27 greatly strengthens the cover flap F by preventing the far left-hand end of the flap outer panel 26 from peeling away from the flap inner panel 25.

The pop-up feature 99 and other aspects of the box will require indicia, such as printing, on the blank. Preferably, the indicia are only placed on a single side of the blank for reduced cost. The side seen in FIG. 2 may be blank, with indicia on the hidden side, to form the box B of FIG. 1.

Figure 3:
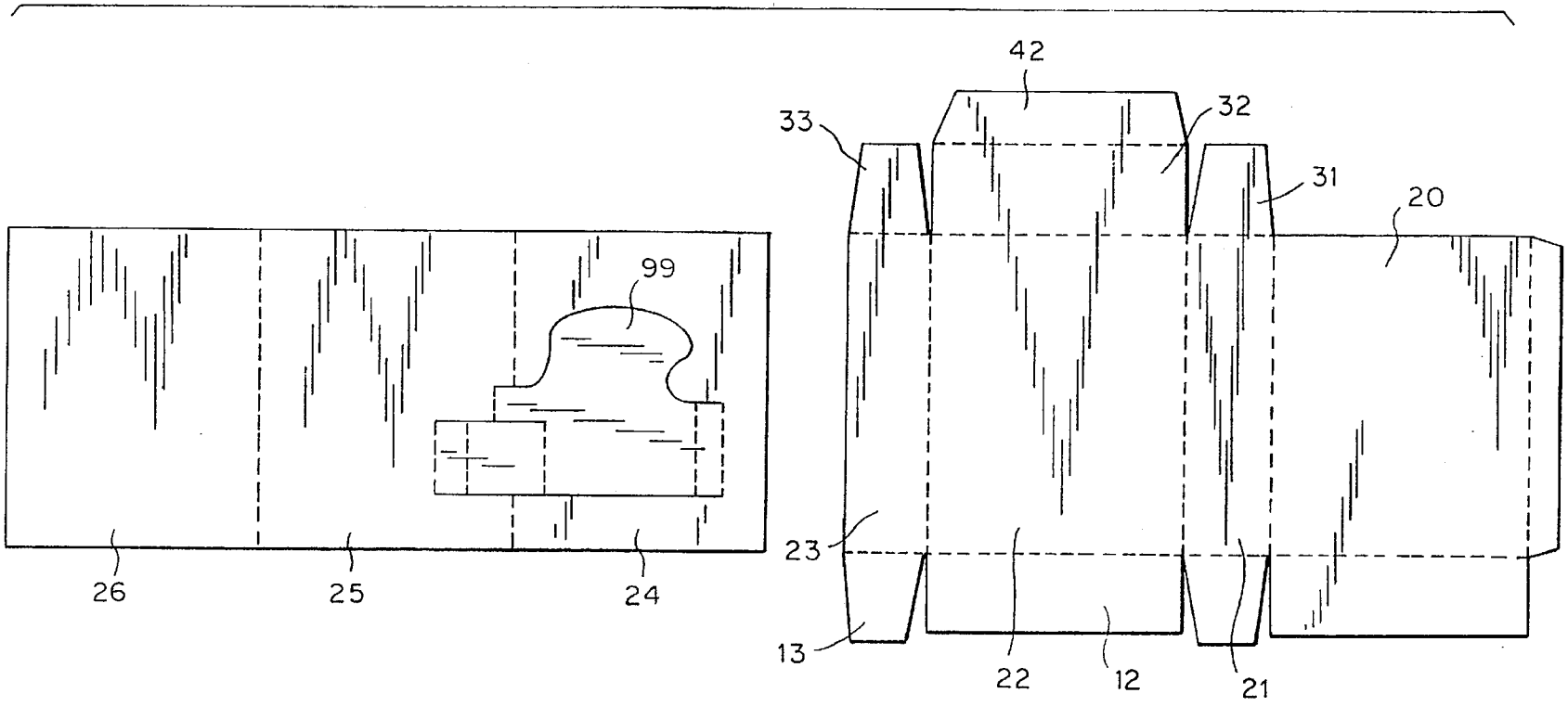
FIG. 3 is a plan view of an alternative blank from which the box of FIG. 1 may be assembled.

A second embodiment of the blank, comprising two pieces, is shown in FIG. 3. In this embodiment, one blank forms a box and the other forms a modified greeting card which can be adhered to the box front. The separation between the sections 23 and 24 allows the two blanks to be made from different widths of paperboard stock, saving materials.

Figure 4:
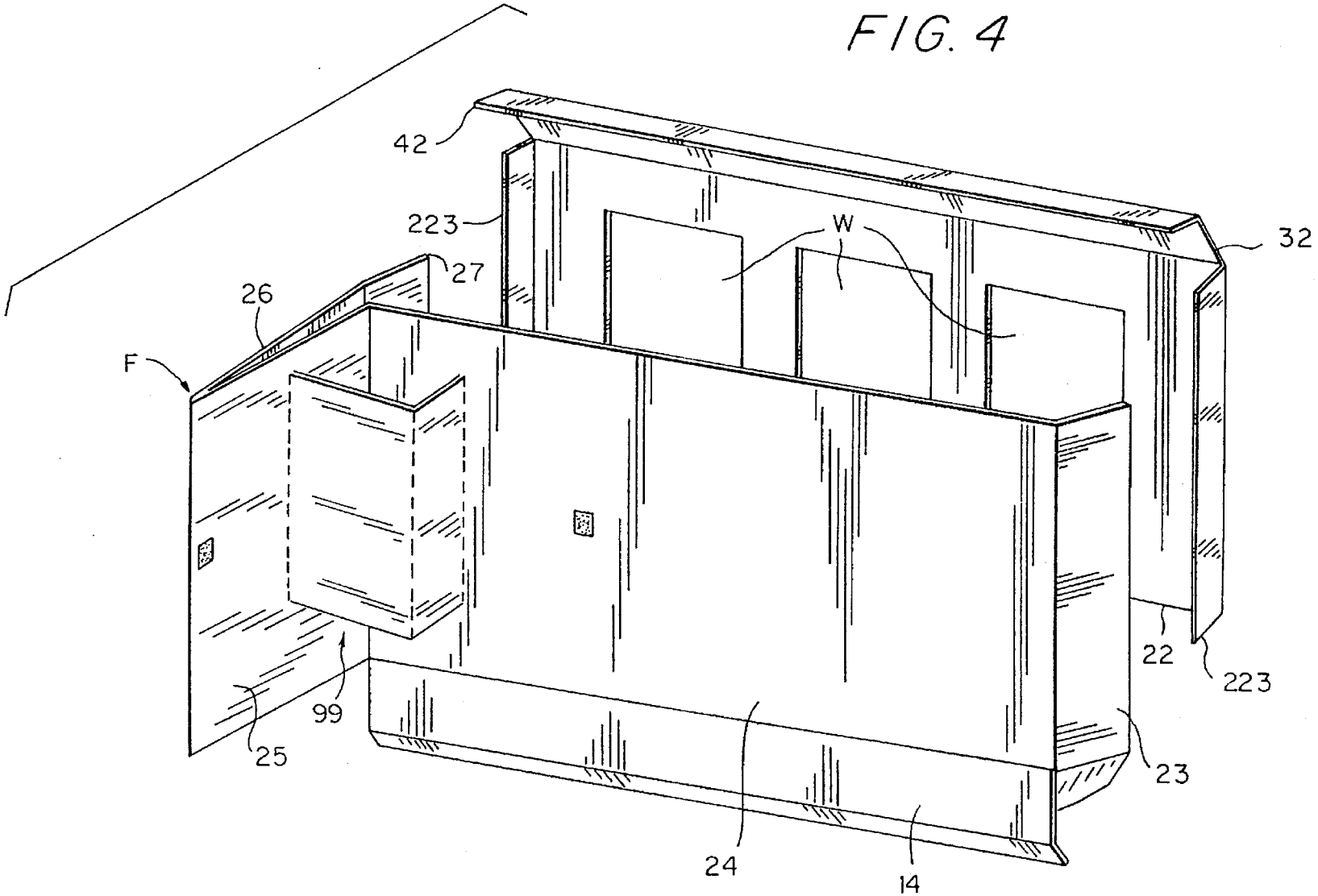
FIG. 4 is a perspective exploded view of a different embodiment of the invention.

A different embodiment of the present invention is shown in FIG. 4. Its assembled shape is like that of the embodiments of FIGS. 1–3 except that the front panel section 24 is elongated by about three times, such that three packs of cards can be fitted inside. The box back section 22 is similarly elongated and optionally includes three windows or openings (either open or covered with transparent material) through which the packs of cards are visible. The same idea may be used for 2, 4, or other numbers of side-by-side packs besides the 3-pack version shown.

Figure 5:
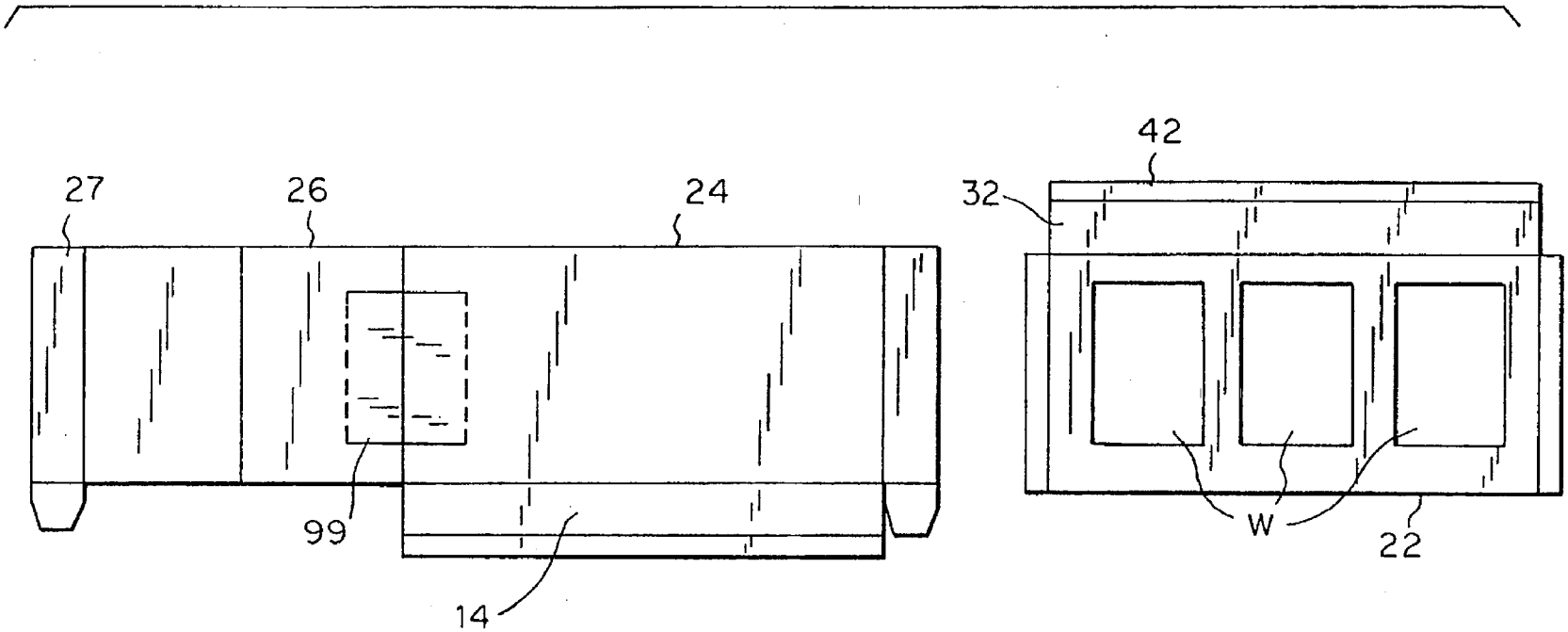
FIG. 5 is a plan view of a blank from which the box of FIG. 4 may be assembled.

Like the embodiment of FIG. 3, the box of FIG. 4 includes a two-part blank which is shown in plan view in FIG. 5. The separation between parts is slightly different from that of FIG. 3, as is be apparent from the drawing. Additional glue tabs 223 are included on either end of the box back section 22.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments, The means and materials for carrying out various disclosed functions may take a variety of alternative forms without departing from the invention. It is to be understood that the phraseology or terminology employed herein is for the purpose of description and not of limitation.

What is claimed is:

1. A pop-up box for pop-up greeting cards, comprising:

a box container having a closable lid and a box front section;

a front cover flap hingedly joined to the container along an edge of the front section, each of the cover flap and the front section including a double-panel construction such that the cover flap and the front section each includes a respective one of a pair of inner panels facing one another when the cover flap is closed against the front section;

a pop-up figure construction disposed between the front section and the cover flap for popping up when the cover flap is rotated about the edge away from the front section, the pop-up figure being formed by cuts and fold lines in both of the inner panels; and closure means for removably holding the cover flap against the front section.

2. The pop-up box according to claim 1, including greeting cards disposed within the container, the greeting cards each including the pop-up figure construction.

3. The pop-up box according to claim 1, wherein the box includes paperboard.

4. The pop-up box according to claim 1, wherein the fastening means includes hook-an-loop fastening material, the fastening material comprising a first patch of hook material joined to selectively the front section and the cover flap, and a second patch of loop material joined to selectively the cover flap and the front cover;

the first patch and the second patch being disposed in corresponding positions such that the first patch and the second patch are aligned and pressed together when the cover flap is against the front section.

5. The pop-up box according to claim 4, wherein the corresponding positions are distal the edge hingedly joining the cover flap to the container and substantially equidistant cover flap corners, the corners being distal the edge.

6. The pop-up box according to claim 1, wherein the edge is vertical and the lid is on a top side of the box.

7. A blank for making a pop-up box, the box having a box height, a box thickness, and a box width, the blank comprising:

a plurality of sections, each of said sections abutting at least one contiguous other one of the sections and coupled thereto along a fold line intermediate therebetween; the plurality further comprising a first set of rectangular sections disposed in a linear array, the linear array having an array width and an array length, the array width being generally equal to the box height; the array comprising in a right-to-left order a box inner front panel section measuring the box height by the box width, a box right side section measuring the box height by the box thickness, a box back section measuring the box height by the box width, a box left side section measuring the box height by the box thickness, a box outer front panel section measuring the box height by the box thickness, a flap inner panel section measuring the box height by the box thickness, and a flap outer panel section measuring the box height by the box thickness; and a second set of sections comprising a box lid section coupled to an upper edge of selectively the box back section and the box inside front panel section, and a box outer bottom section coupled to a lower edge of selectively the inner front panel section and the box inside front panel section;

wherein the outer front panel section and the flap inner panel section include pop-up fold lines and cut lines forming a pop-up figure construction;

whereby the plurality of sections may be constructed to form a pop-up box.

8. The blank according to claim 7, comprising a box inner bottom section coupled to a lower edge of selectively the box inside front panel section and the inner front panel section, whereby the outer bottom section may be adhered onto the box outer bottom section to form a double-panel bottom for the box.

9. The blank according to claim 7, comprising a box lid closure tab coupled to the box lid section distal the upper edge of selectively the box back section and the box inside front panel section.

10. The blank according to claim 7, comprising a flap-facing reinforcement tab coupled to the flap inner panel section at an end of the linear array of the first set of rectangular sections.

11. The blank according to claim 7, including sheet blank material, the blank material including paperboard.

12. The blank according to claim 7, including indicia on a single side of the blank.

13. The blank according to claim 7, including a first patch of hook material joined to selectively the inner front panel and the flap inner panel section and a second patch of loop material joined to selectively the flap inner panel section and the inner front panel;

the first patch and the second patch being disposed equidistant from a fold line coupling the flap inner panel section and the inner front panel and equidistant from a bottom edge of the first array.

14. The blank according to claim 7, wherein the blank comprises two separate pieces.

* * * * *